US011538423B2

(12) United States Patent
Kim

(10) Patent No.: US 11,538,423 B2
(45) Date of Patent: Dec. 27, 2022

(54) DISPLAY DEVICE AND DRIVING METHOD THEREOF

(71) Applicant: LG Display Co., Ltd., Seoul (KR)

(72) Inventor: Min Cheol Kim, Gwangmyeong-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/483,699

(22) Filed: Sep. 23, 2021

(65) Prior Publication Data

US 2022/0148520 A1 May 12, 2022

(30) Foreign Application Priority Data

Nov. 12, 2020 (KR) ..... 10-2020-0150756

(51) Int. Cl.
*G09G 3/3291* (2016.01)
*G09G 3/3233* (2016.01)
*G09G 3/20* (2006.01)

(52) U.S. Cl.
CPC ..... *G09G 3/3291* (2013.01); *G09G 3/2003* (2013.01); *G09G 3/3233* (2013.01); *G09G 2300/0452* (2013.01); *G09G 2310/08* (2013.01); *G09G 2320/0257* (2013.01); *G09G 2320/043* (2013.01); *G09G 2360/16* (2013.01)

(58) Field of Classification Search
CPC ..... G09G 2300/0452; G09G 2310/08; G09G 2320/0257; G09G 2320/043; G09G 2360/16; G09G 3/2003; G09G 3/3233; G09G 3/3291
See application file for complete search history.

(56) References Cited

U.S. PATENT DOCUMENTS

2017/0061852 A1* 3/2017 Byun ..... G09G 3/2055
2018/0047348 A1* 2/2018 Yamanaka ..... G02F 1/133512
2019/0228738 A1* 7/2019 Yang ..... G09G 5/10
2020/0143751 A1* 5/2020 Byun ..... G09G 3/3291
2021/0225327 A1* 7/2021 Matsumoto ..... G09G 3/3233
2021/0335288 A1* 10/2021 Jeon ..... G09G 3/3406
2022/0068216 A1* 3/2022 Yoon ..... G09G 3/3266

FOREIGN PATENT DOCUMENTS

KR 10-2015-0018725 A 2/2015
KR 10-2015-0078029 A 7/2015
KR 10-2016-0056708 A 5/2016
KR 10-2016-0071886 A 6/2016
KR 10-2017-0037783 A 4/2017

* cited by examiner

*Primary Examiner* — Kenneth Bukowski
(74) *Attorney, Agent, or Firm* — Morgan, Lewis & Bockius LLP

(57) ABSTRACT

A display device includes a timing controller for calculating an average luminance for each subpixel with respect to an input image, calculating afterimage influence for each subpixel for determining a possibility of causing afterimage for each subpixel position on the basis of the average luminance, and deriving a compensation gain for each subpixel on the basis of the afterimage influence for each subpixel to provide the input image as a compensated image, a data driver for outputting a data voltage on the basis of the compensated image output from the timing controller, and a display panel for displaying an image on the basis of the data voltage.

7 Claims, 19 Drawing Sheets

APL 32% : Luminance (afterimage influence) range 0 ~ 0.8 → SubPixel Gain ↑

APL 70% : Luminance (afterimage influence) range0 ~ 0.4 → SubPixel Gain ↓

(b)Green SubPixel → High logo stress is accumulated (c)Blue SubPixel → Logo stress accumulation is insignificant

FIG. 18

[Memory ]

| | [0] | ... | [N-1] |
|---|---|---|---|
| # of SubPixel | $avg_R(M-N)$ | ... | $avg_R(M-1)$ |
| | $avg_G(M-N)$ | ... | $avg_G(M-1)$ |
| | $avg_B(M-N)$ | ... | $avg_B(M-1)$ |
| | $avg_W(M-N)$ | ... | $avg_W(M-1)$ |

※ Memory Size (bit) = # of SubPixel x N x bit depth

Average luminance information of N frames is stored for each subpixel and updated into current frame and N previous frame information per frame Afterimage improvement rate of embodiment in comparison with comparative example ❖ Based on Korea daily video

DISPLAY DEVICE AND DRIVING METHOD THEREOF

This application claims the benefit of Korean Patent Application No. 10-2020-0150756, filed on Nov. 12, 2020, which is hereby incorporated by reference as if fully set forth herein.

BACKGROUND

Technical Field

The present disclosure relates to a display device and a driving method thereof.

Discussion of the Related Art

With the development of information technology, the market for display devices that are connection media between users and information is growing. Accordingly, display devices such as a light emitting display device (LED), a quantum dot display device (QDD), and a liquid crystal display device (LCD) are increasingly used.

The aforementioned display devices include a display panel having subpixels, a driver for outputting driving signals for driving the display panel, a power supply for generating power to be supplied to the display panel or the driver, and the like.

The aforementioned display devices can display images according to transmission of light or direct emission of light through selected subpixels when driving signals, for example, scan signals and data signals, are provided to subpixels formed in a display panel.

SUMMARY

Accordingly, embodiments of the present disclosure are directed to a display device and a driving method thereof that substantially obviate one or more of the problems due to limitations and disadvantages of the related art.

An aspect of the present disclosure is to provide a display that may improve display quality of images and increase the lifespan of a display device by reducing a possibility of generation of afterimage lay due to deterioration.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display device comprises a timing controller for calculating an average luminance for each subpixel with respect to an input image, calculating afterimage influence for each subpixel for determining a possibility of causing afterimage for each subpixel position on the basis of the average luminance, and deriving a compensation gain for each subpixel on the basis of the afterimage influence for each subpixel to provide the input image as a compensated image, a data driver for outputting a data voltage on the basis of the compensated image output from the timing controller, and a display panel for displaying an image on the basis of the data voltage.

The timing controller may provide the compensated image by decreasing a luminance of a region having the afterimage influence in the input image in advance such that the possibility of causing afterimage is reduced.

The timing controller may provide the input image as the compensated image by weighting the compensation gain for each subpixel on the basis of a normalized luminance to derive a total gain corresponding to gains for positions of all pixels included in the input image, and commonly applying the total gain to all the pixels.

The timing controller may use an average luminance of a previous image in calculation of a current image for real-time compensation if data similarity between neighboring images is high.

The timing controller may determine that the larger a difference between an average luminance of a current image and a luminance of a current pixel, the higher the afterimage influence.

The timing controller may separate channels for subpixels along with calculation of the average luminance for each subpixel with respect to the input image.

The timing controller may calculate the average luminance for each subpixel with respect to the input image per frame, store the average luminance in a memory, update the average luminance, and perform an operation of retrieving the average luminance for each subpixel from the memory whenever calculating the afterimage influence for each subpixel.

In another aspect, a method of driving a display device comprises calculating an average luminance for each subpixel with respect to an input image, calculating afterimage influence for each subpixel for determining a possibility of causing afterimage for each subpixel position on the basis of the average luminance, providing the input image as a compensate image by deriving and applying a compensation gain for each subpixel on the basis of the afterimage influence for each subpixel, and displaying an image on the basis of the compensated image.

The compensated image may be provided by decreasing a luminance of a region having the afterimage influence in the input image in advance such that the possibility of causing afterimage is reduced.

The providing of the input image as a compensated image may include weighting the compensation gain for each subpixel on the basis of a normalized luminance to derive a total gain corresponding to gains for positions of all pixels included in the input image, and commonly applying the total gain to all the pixels.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles.

Figure 5:
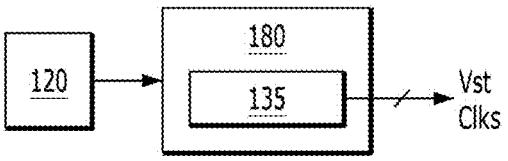

4 and FIG. 5 illustrate configurations of devices related to the gate in panel type scan drivers.

Figure 6:
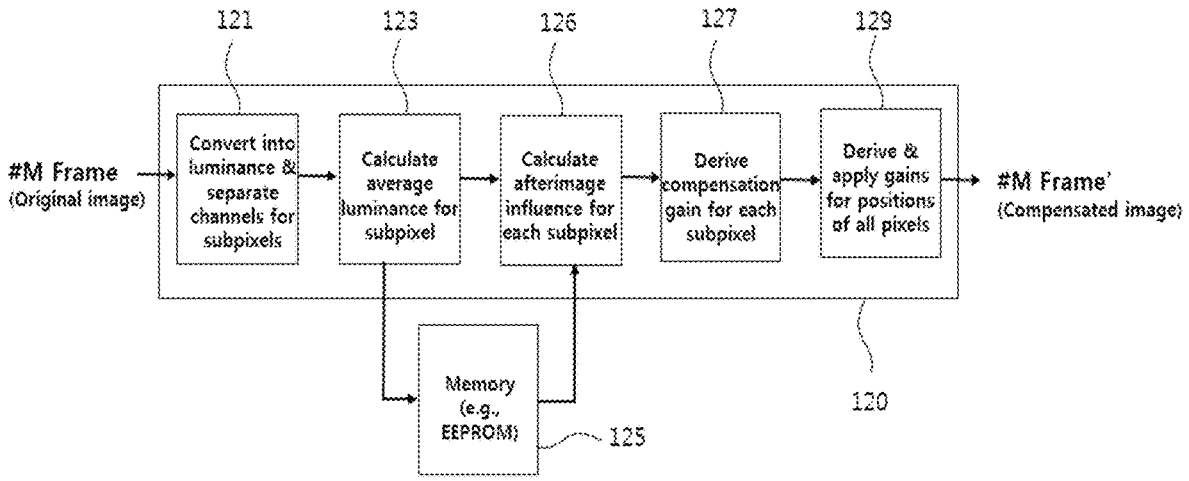

FIG. 6 is a diagram showing a timing controller and a memory according to a first embodiment of the present invention and FIG. 7 to FIG. 10 are diagrams for describing functions of the timing controller according to the first embodiment of the present invention.

Figure 11:
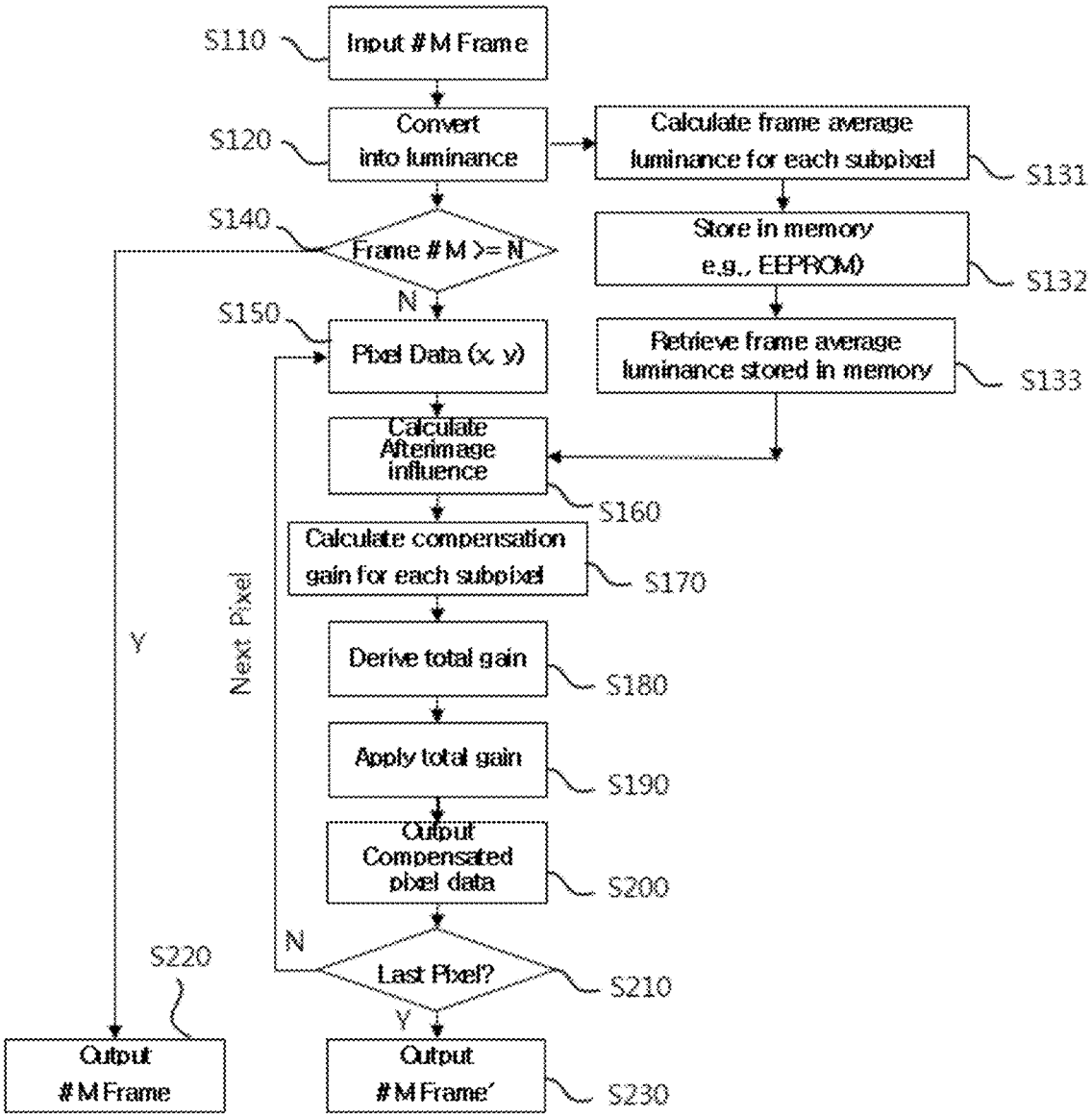
Figure 19:
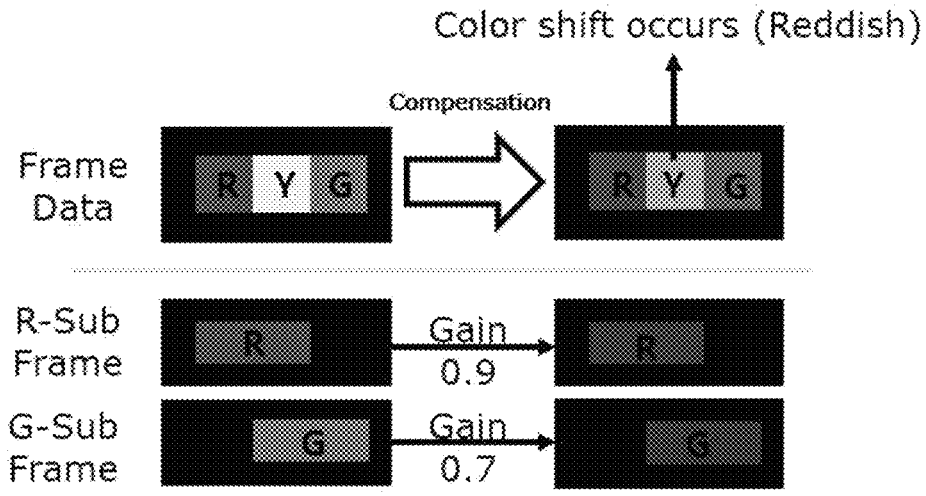
Figure 20:
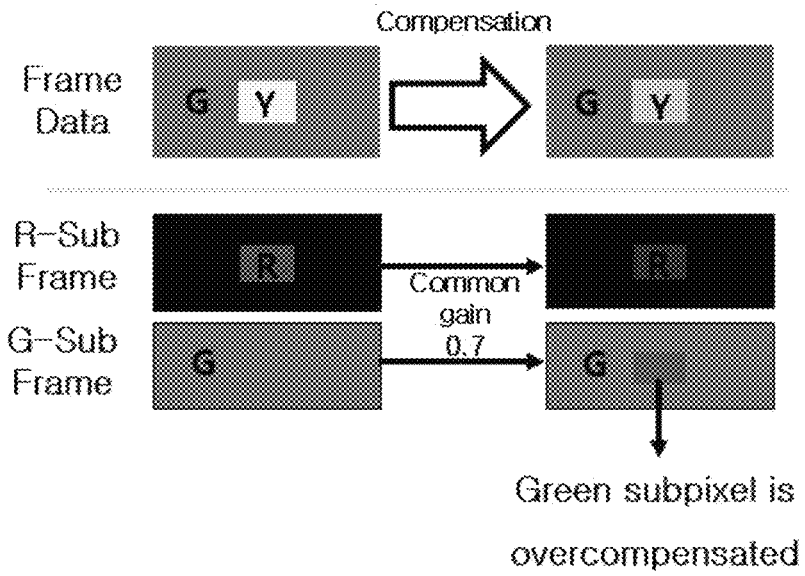
Figure 21:
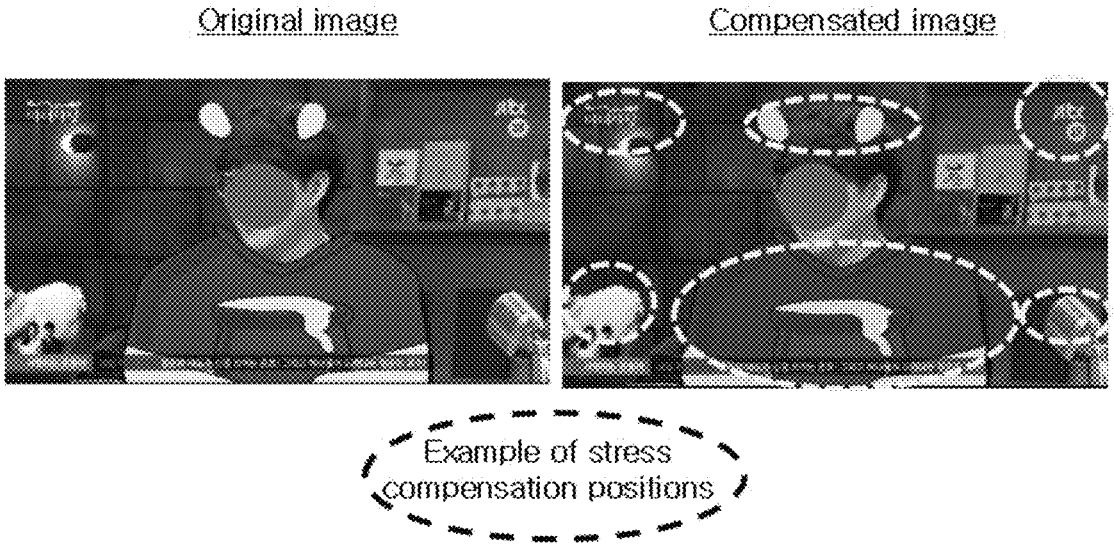

FIG. 11 is a flowchart showing an afterimage delaying method based on subpixel stress analysis according to a second embodiment of the present invention, FIG. 12 to FIG. 20 are diagrams for describing the afterimage delaying method according to the second embodiment of the present invention, and FIG. 21 illustrates stress compensation positions according to the second embodiment of the present invention.

Figure 22:
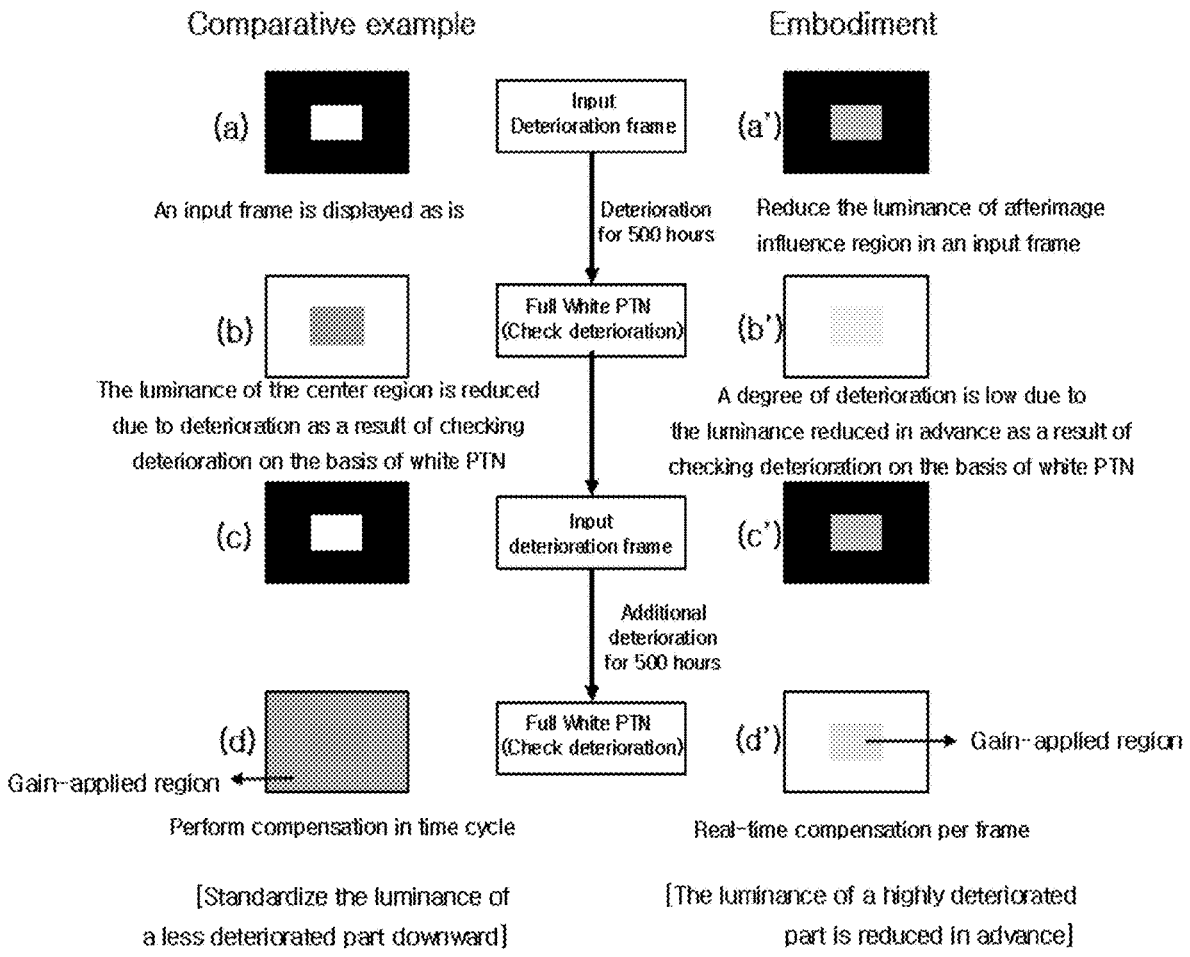
Figure 23:
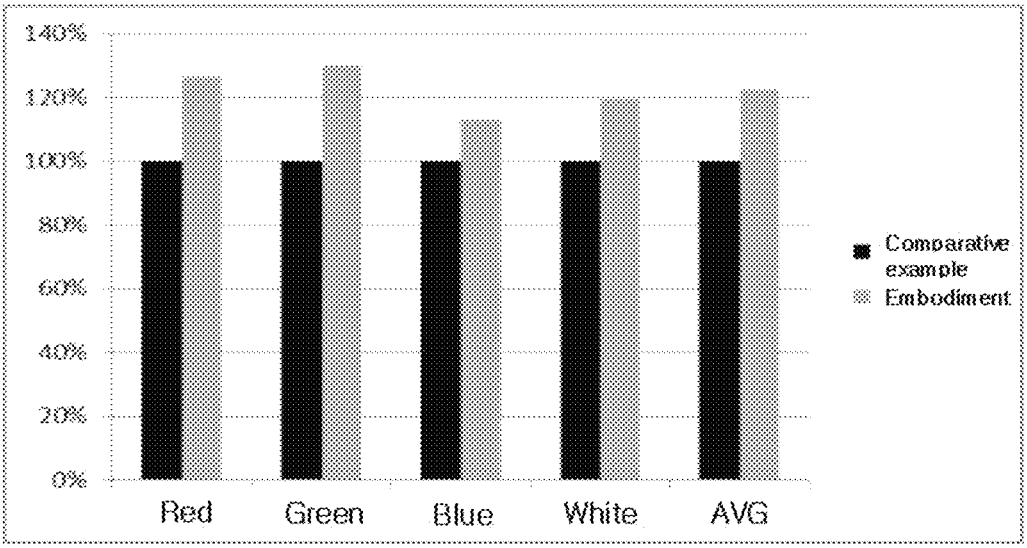

FIG. 22 and FIG. 23 are diagrams for explaining a comparative example and an embodiment of the present invention.

DETAILED DESCRIPTION

A display device according to the present disclosure may be realized by a television system, a video player, a personal computer (PC), a home theater, a vehicle electric apparatus, and a smartphone, but the present invention is not limited thereto. The display device according to the present invention may be realized by a light emitting display device (LED), a quantum dot display device (QDD), a liquid crystal display device (LCD), or the like. However, a light emitting display device that directly emits light based on inorganic light emitting diodes or organic light emitting diodes will be described as an example for convenience of description.

Figure 1:
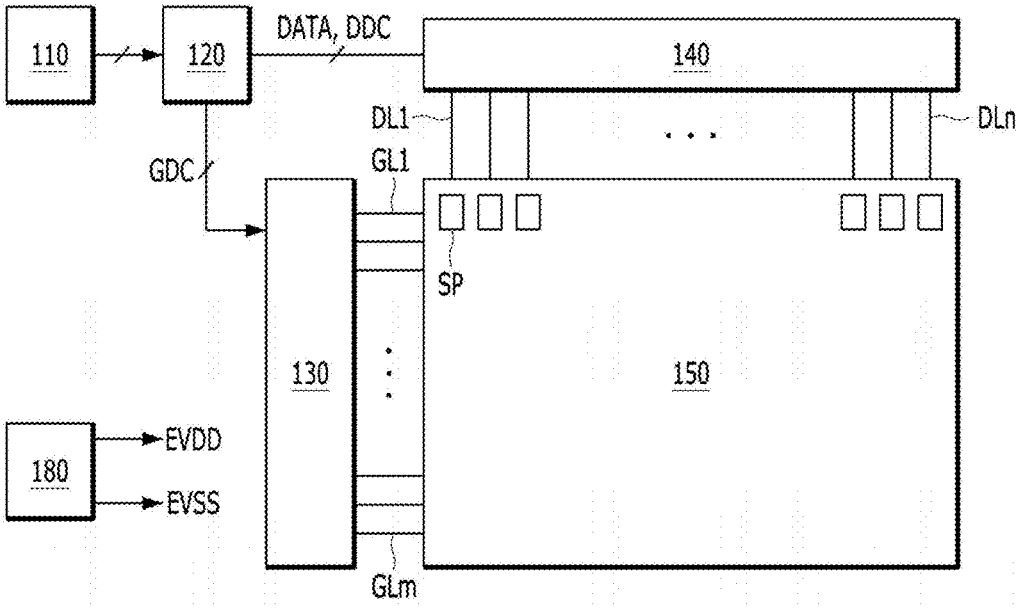
FIG. 1 is a block diagram schematically showing a light-emitting display device and FIG. 2 is a configuration diagram schematically showing a subpixel illustrated in FIG. 1.
Figure 2:
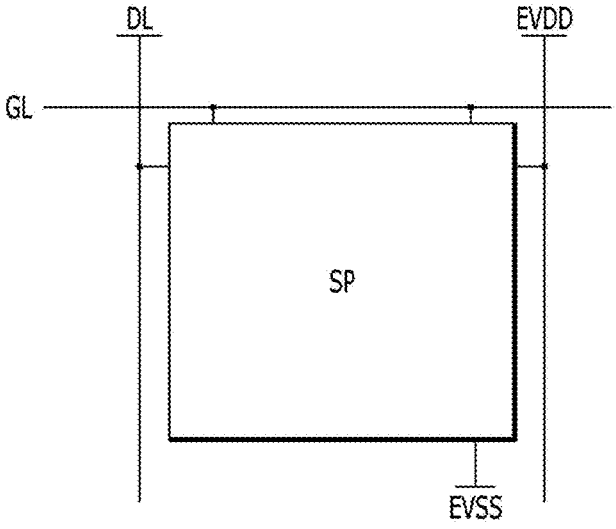

FIG. 1 is a block diagram schematically showing a light emitting display device and FIG. 2 is a configuration diagram schematically showing a subpixel illustrated in FIG. 1.

As illustrated in FIG. 1 and FIG. 2, the light emitting display device may include an image provider 110, a timing controller 120, a scan driver 130, a data driver 140, a display panel 150, and a power supply 180.

The image provider 110 (or host system) may output various driving signals along with an image data signal supplied from the outside or an image data signal stored in an internal memory. The image provider 110 may provide data signals and various driving signals to the timing controller 120.

The timing controller 120 may output a gate timing control signal GDC for controlling operation timing of the scan driver 130, a data timing control signal DDC for controlling operation timing of the data driver 140, and various synchronization signals (a vertical synchronization signal Vsync and a horizontal synchronization signal Hsync). The timing controller 120 may provide the data timing control signal DDC and a data signal DATA supplied from the image provider 110 to the data driver 140. The timing controller 120 may be formed in the form of an integrated circuit (IC) and mounted on a printed circuit board, but the present invention is not limited thereto.

The scan driver 130 may output a scan signal (or a scan voltage) in response to the gate timing control signal GDC supplied from the timing controller 120. The scan driver 130 may provide the scan signal to subpixels included in the display panel 150 through scan lines GL1 to GLm. The scan driver 130 may be formed in the form of an IC or directly formed on the display panel 150 in a gate in panel structure, but the present invention is not limited thereto.

The data driver 140 may sample and latch the data signal DATA in response to the data timing control signal DDC supplied from the timing controller 120, convert the data signal in a digital form into a data voltage in an analog form on the basis of a gamma reference voltage, and output the data voltage. The data driver 140 may provide the data voltage to the subpixels included in the display panel 150 through data lines DL1 to DLn. The data driver 140 may be formed in the form of an IC and mounted on the display panel 150 or mounted on a printed circuit board, but the present invention is not limited thereto.

The power supply 180 may generate a first power at a high voltage and a second power at a low voltage on the basis of an external input voltage supplied from the outside and output the first power and the second power through a first power line EVDD and a second power line EVSS. The power supply 180 may generate and output voltages (e.g., gate voltages including a gate high voltage and a gate low voltage) necessary for operation of the scan driver 130 or voltages (drain voltages including a drain voltage and a half drain voltage) necessary for operation of the data driver 140 as well as the first power and the second power.

The display panel 150 may display an image in response to driving signals including a scan signal and a data voltage, the first power, and the second power. The subpixels of the display panel 150 can directly emit light. The display panel 150 may be manufactured based on a rigid or flexible substrate such as a glass substrate, a silicon substrate, or a polyimide substrate. In addition, the subpixels emitting light may include red, green and blue subpixels or red, green, blue, and white subpixels.

For example, a single subpixel SP may include a pixel circuit connected to a data line DL, a scan line GL, the first power line EVDD, and the second power line EVSS. The pixel circuit may include a switching transistor, a driving transistor, a storage capacitor, and an organic light emitting diode. The subpixel SP used in a light emitting display device has a complicated circuit configuration because it directly emits light. Further, there are various compensation circuits for compensating for deterioration of the driving transistor that provides a driving current to the organic LED as well as the organic LED emitting light. Accordingly, the subpixel SP is simply illustrated in the form of a block.

The timing controller 120, the scan driver 130, and the data driver 140 are described as individual components in the above description. However, one or more of the timing controller 120, the scan driver 130, and the data driver 140 may be integrated into a single IC according to a light emitting display device implementation method.

Figure 3A:
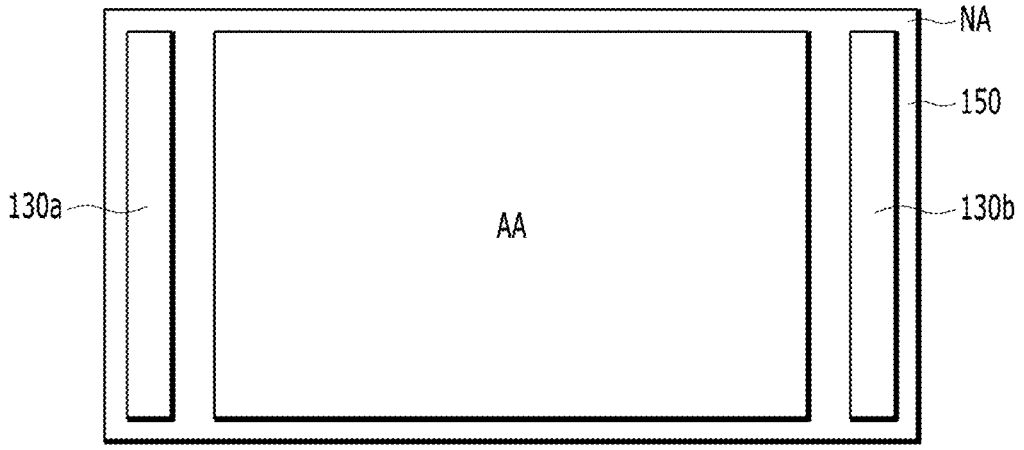
FIG. 3A and FIG. 3B are diagrams showing an example of arrangement of gate in panel type scan drivers, and FIG.
Figure 3B:
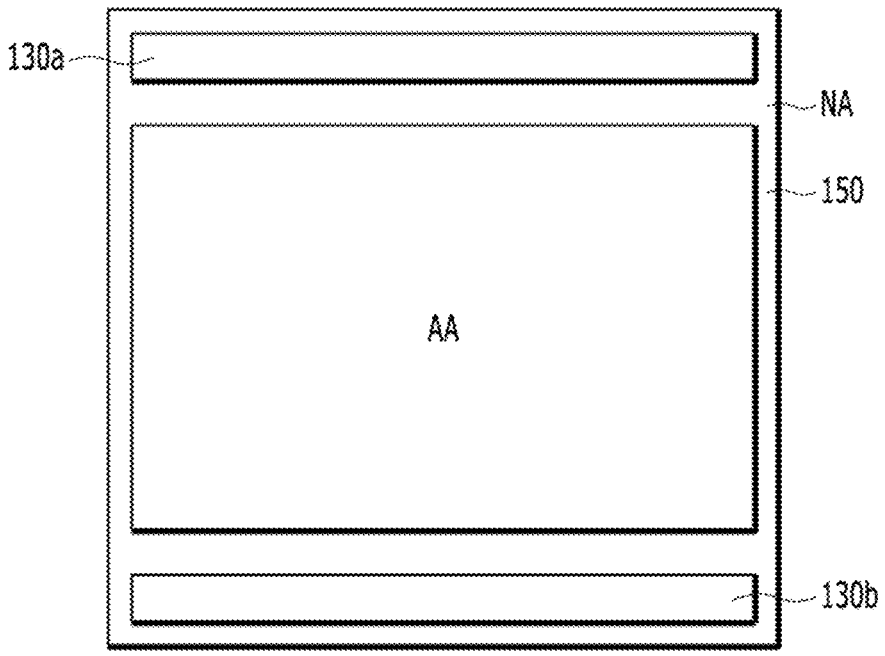
Figure 4:
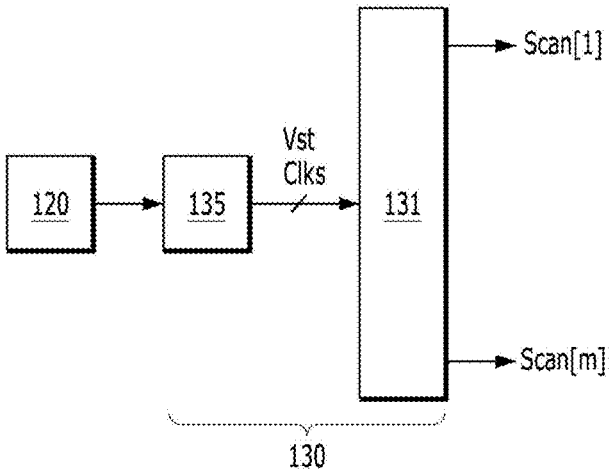

FIG. 3A and FIG. 3B are diagrams showing an example of arrangement of gate in panel type scan drivers and FIG. 4 and FIG. 5 illustrate configurations of devices related to the gate in panel type scan drivers.

As illustrated in FIG. 3A and FIG. 3B, the gate in panel type scan drivers 130*a* and 130*b* may be disposed in a non-display area NA of the display panel 150. The scan drivers 130*a* and 130*b* may be disposed in left and right non-display areas NA of the display panel 150, as shown in FIG. 3A. Further, the scan drivers 130*a* and 130*b* may be disposed in upper and lower non-display areas NA of the display panel 150, as shown in FIG. 3B.

Although an example in which the scan drivers 130*a* and 130*b* are disposed in the left and right non-display areas NA or the upper and lower non-display areas NA of a display area AA has been illustrated and described, only one scan driver may be disposed in the left, right, upper or lower non-display area NA.

As illustrated in FIG. 4, the gate in panel type scan driver 130 may include a shift register 131 and a level shifter 135.

The level shifter 135 may generate clock signals Clks and a start signal Vst on the basis of signals output from the timing controller 120. The clock signals Clks may be generated in the form of J-phase (J being an integer equal to or greater than 2) signals having different phases, such as 2 phases, 4 phases, or 8 phases.

The shift register 131 operates on the basis of the signals Clks and Vst output from the level shifter 135 and may output scan signals Scan[1] to Scan[m] for turning on or off transistors formed in the display panel. The shift register 131 may be formed on the display panel in the form of a thin film in a gate in panel structure. Accordingly, a part of the scan driver 130 which is formed on the display panel may be the shifter register 131. In addition, reference numbers 130*a* and 130*b* in FIG. 3A and FIG. 3B may correspond to reference number 131.

As illustrated in FIG. 4 and FIG. 5, the level shifter 135 may be formed in the form of an IC differently from the shift register 131 or may be included in the power supply 180. However, this is merely an example and the present invention is not limited thereto.

FIG. 6 is a diagram showing a timing controller and a memory according to a first embodiment of the present invention and FIG. 7 to FIG. 10 are diagrams for describing functions of the timing controller according to the first embodiment of the present invention.

As illustrated in FIG. 6, the timing controller 120 may include a first circuit 121, a second circuit 123, a third circuit 126, a fourth circuit 127, and a fifth circuit 129. The timing controller 120 may use a single memory 125 (e.g., EEPROM) in order to compensate for an input original image #M Frame and output a compensated image #M Frame' on the basis of the aforementioned configuration.

Figure 7:
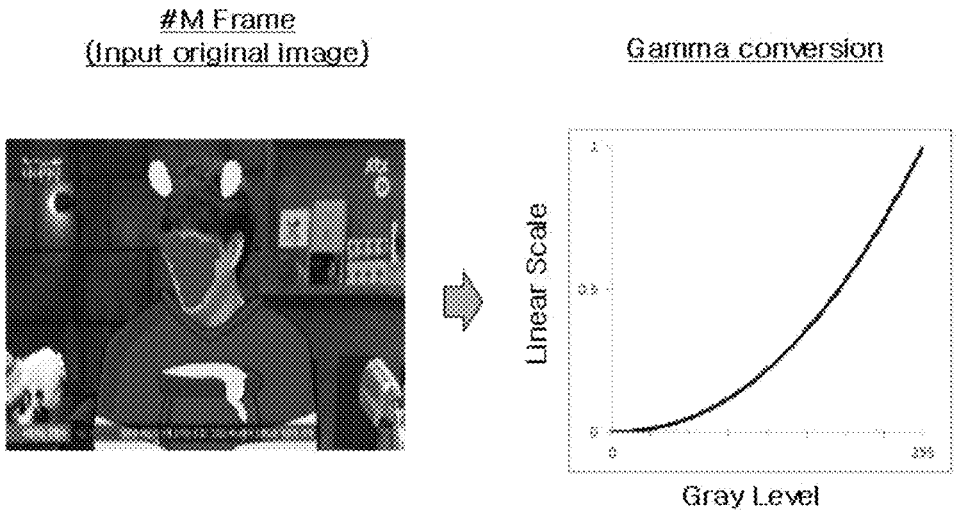
Figure 8:
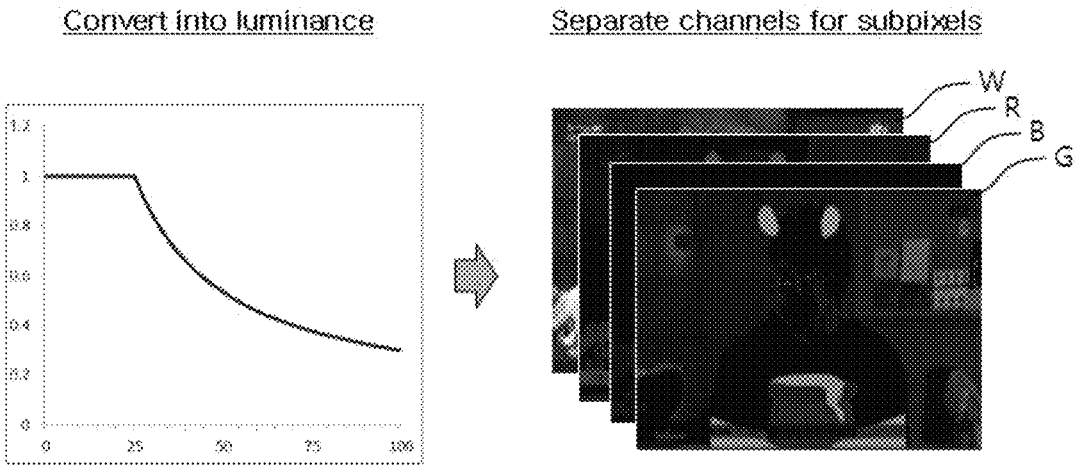
Figure 9:
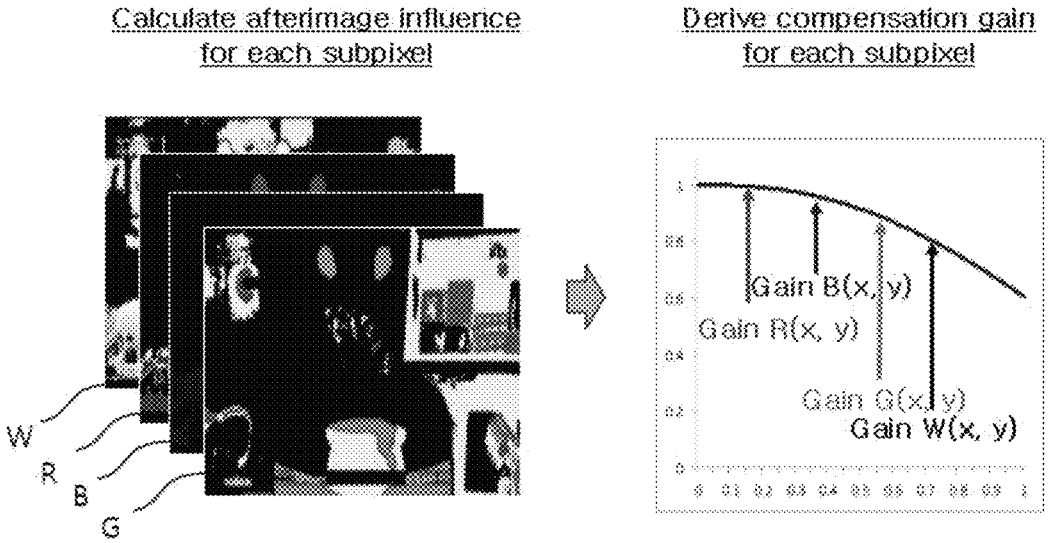

The first circuit 121 may convert the input original image #M Frame into luminance and separate channels for subpixels RGB or RGBW. The first circuit 121 may perform a gamma conversion process and a luminance conversion process as illustrated in FIG. 7 and FIG. 8 in order to convert the original image #M Frame into luminance. FIG. 8 shows an example of obtaining a total of four subpixels of a white subpixel (W), a red subpixel (R), a blue subpixel (B), and a green subpixel (G) through separation of channels for subpixels from the original image #M Frame, but the present invention is not limited thereto.

The second circuit 123 may receive subpixel data converted into luminance from the first circuit 121 and calculate an average luminance value for each subpixel. The second circuit 123 may calculate average luminance values of a frame image for the white subpixel (W), the red subpixel (R), the blue subpixel (B), and the green subpixel (G), and these average luminance values of the frame image may be calculated per frame and stored in the memory 125.

The third circuit 126 may calculate afterimage influence for each subpixel on the basis of the average luminance values of the frame image calculated by the second circuit. Here, afterimage may be recognized in a relatively less deteriorated part than the surrounding part. Accordingly, the third circuit 126 may retrieve average luminance values of the frame image stored in the memory 125 and then calculate afterimage influence for evaluating (determining) a possibility of causing afterimage at the position of each subpixel (or pixel) on the basis of the average luminance values of the frame image (or peripheral stress). The average luminance values of the frame image may be calculated per frame, stored in the memory 125, and updated. In addition, the third circuit 126 (timing controller in a broad sense) may perform an operation of retrieving an average luminance for each subpixel from the memory 125 whenever calculating the afterimage influence for each subpixel.

The fourth circuit 127 may receive afterimage influence data from the third circuit 126 and derive a compensation gain for each subpixel. The fourth circuit 127 may derive a compensation gain for compensating for stress that may be applied to each subpixel on the basis of afterimage influence data provided in the form of a specific curve depending on a possibility of causing afterimage. As a result, different compensation gain values for the white subpixel (W), the red subpixel (R), the blue subpixel (B), and the green subpixel (G), and positions of pixels may be derived as represented by "Gain R(x, y), Gain B(x, y), Gain G(x, y), and Gain W(x, y)" in FIG. 9.

Figure 10:
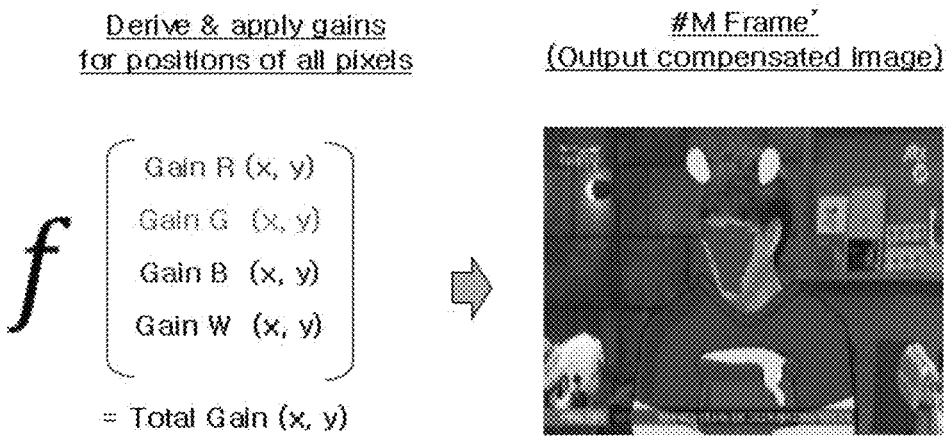

The fifth circuit 129 may receive compensation gain values for respective subpixels from the fourth circuit 127, derive and apply gains for positions of all pixels, and then output the compensated image #M Frame'. The fifth circuit 129 may derive a total gain (Total Gain (x, y)) on the basis of the compensation gains and luminances of the white subpixel (W), the red subpixel (R), the blue subpixel (B), and the green subpixel (G), as shown in FIG. 10, in order to derive and apply the gains for positions of all pixels. Then, the derived total gain (Total Gain (x, y)) may be commonly applied to all pixels (or all subpixels). When the total gain (Total Gain (x, y)) is commonly applied to all pixels (or all subpixels) in this manner, it is possible to solve a color distortion problem as compared to a method of respectively applying gains to subpixels.

FIG. 11 is a flowchart showing an afterimage delaying method based on subpixel stress analysis according to a second embodiment of the present invention, FIG. 12 to FIG. 20 are diagrams for describing the afterimage delaying method according to the second embodiment of the present invention, and FIG. 21 illustrates stress compensation positions according to the second embodiment of the present invention.

As illustrated in FIG. 11, the second embodiment of the present invention pertains to an afterimage delaying method based on subpixel stress analysis. The second embodiment of the present invention may be performed on the basis of the light emitting display device including the timing controller 120 and the memory 125 described in the first embodiment, and a flow of the afterimage delaying method is as follows.

First, when an original image #M Frame is input (S110), the input original image #M Frame may be converted into luminance (S120). Luminance (element stress) may vary according to an average picture level (APL) of a frame image even if frame images have the same code value. Meanwhile, when the input original image #M Frame is converted into luminance, it is possible to easily determine presence or absence of afterimage influence and to compensate for a part having the afterimage influence on the basis of the APL of the frame image in subsequent step.

Figure 12:
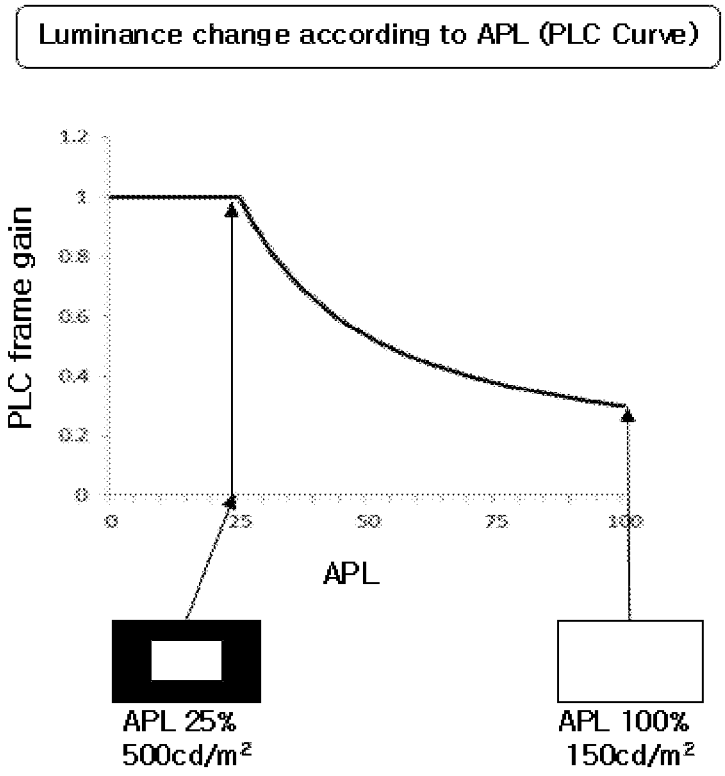

As can be ascertained from "APL 100%→150 cd/m$^2$" and "25%→500 cd/m$^2$" in FIG. 12, luminance can be set to be higher when the APL of the frame image is low than when the APL of the frame is high. When gains are set such that luminance can be controlled with respect to APL in this manner, power consumption can be reduced. However, when luminance is controlled depending on APL as illustrated in FIG. 12, the afterimage influence may be low due to low luminance (=low element stress) when the APL of the frame image is high and may be high due to high luminance (=high element stress) when the APL of the frame image is low.

Figure 13:
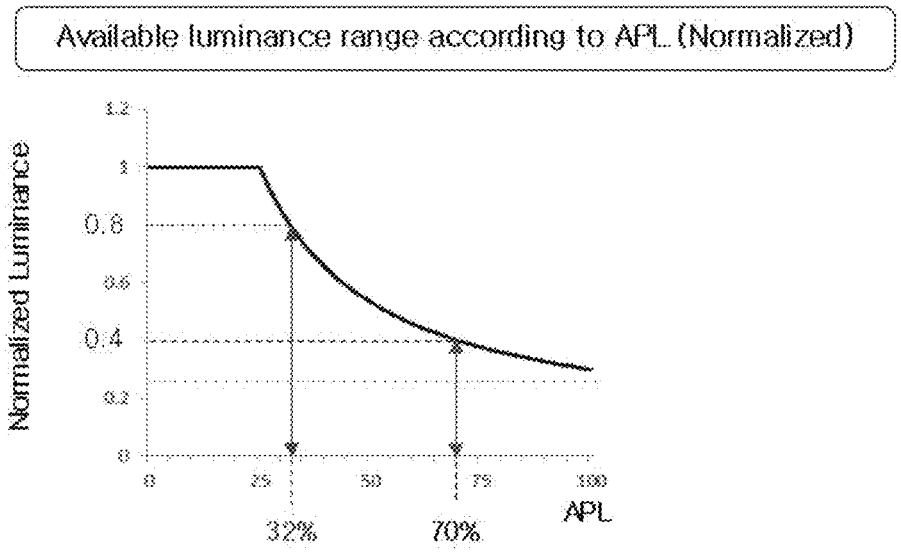

As illustrated in FIG. 13, a luminance (afterimage influence) range may be 0 to 0.8 when APL is 32% and 0 to 0.4 when APL is 70%. In comparison between these two luminance ranges, a relatively high subpixel gain may be applied when APL is low and a relatively low subpixel gain may be applied when APL is high.

Figure 14:
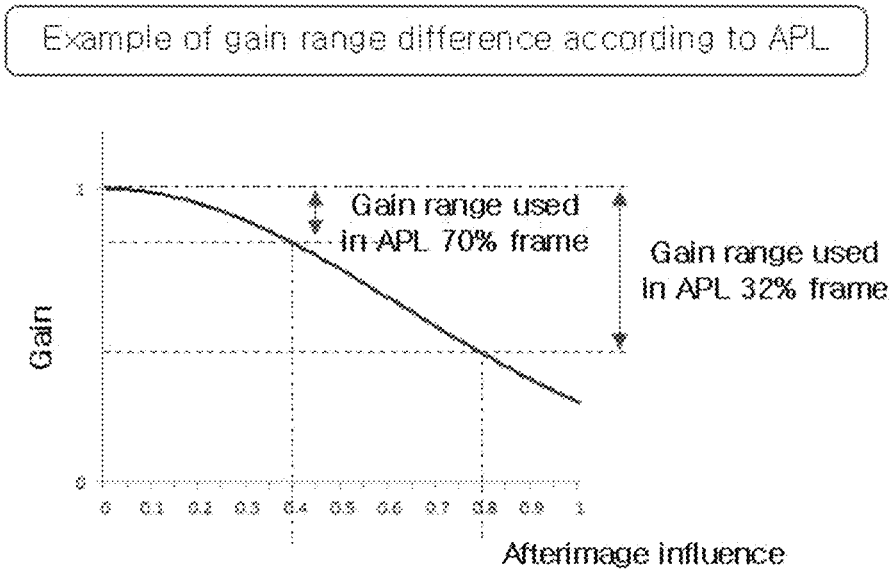

As illustrated in FIG. 14, a gain range (variable margin) used in a frame image with APL 70% is relatively narrow, whereas a gain range (variable margin) used in a frame image with APL 30% is relatively wide. That is, an applicable gain range widens as APL decreases, and thus a higher gain may be applied.

The luminance control method using APL can reduce power consumption in this manner, but the afterimage influence may vary according to APL. However, the afterimage influence may be easily estimated on the basis of normalized luminance that is an available luminance range, and a gain range for compensating for the afterimage influence may be easily estimated.

Accordingly, when the input original image #M Frame is converted into luminance, it is possible to easily estimate a degree of stress that may be applied to each subpixel and compensate for the stress on the basis of final output luminance in which APL has been reflected.

Next, a frame average luminance value for each subpixel may be calculated (S120) and stored in the memory (S132) after conversion of the input original image #M Frame into luminance. The frame average luminance value for each subpixel may be calculated on the basis of Equation 1 to Equation 4.

$$Avg_R = \sum_{i=M-N}^{M-1} avg_R(i) \quad \text{[Equation 1]}$$

$$Avg_B = \sum_{i=M-N}^{M-1} avg_B(i) \quad \text{[Equation 2]}$$

$$Avg_G = \sum_{i=M-N}^{M-1} avg_G(i) \quad \text{[Equation 3]}$$

$$Avg_W = \sum_{i=M-N}^{M-1} avg_W(i) \quad \text{[Equation 4]}$$

The frame average luminance value stored in the memory may be retrieved when the afterimage influence is calculated in the subsequent step (S133). In addition, the frame average luminance value for each subpixel may be calculated and updated per frame.

Next, arbitrary N and M may be compared with each other, such as "Frame #M≥N" (S140). The step of comparing whether a current frame image #M is greater than N may be used when real-time compensation is performed. Initial 0 to (N−1) frames are output as they are without compensation because there is no average data of the N frames, and the next step S150 may be executed from the N-th frame in order to perform compensation using a cumulative average of the 0 to (N−1) frames.

However, when real-time compensation is not performed, an average luminance value of a current frame image is calculated without using previous N frame images, and thus the operation of step S140 such as "Frame #M N" may be skipped or omitted and the flow may proceed to Frame #M output step (S220) such that compensation can be immediately performed. For example, when N=0 is set, step S140 such as "Frame #M N" may be skipped.

Next, pixel data may be calculated for each position, such as "Pixel Data (x, y)", in order to derive and apply the afterimage influence, compensation gains, and a total gain for all pixels converted into luminances (S150). Next, the frame average luminance value stored in the memory may be retrieved and the afterimage influence for each subpixel may be calculated on the basis of the frame average luminance value (S160). For example, if pixel data (RGB of the current subpixel) and the frame average luminance value have a considerable difference therebetween, stress of the corresponding pixel may be regarded as high. Hereinafter, the necessity for stress analysis for each subpixel and an example of afterimage analysis for green subpixels will be described.

Figure 15:
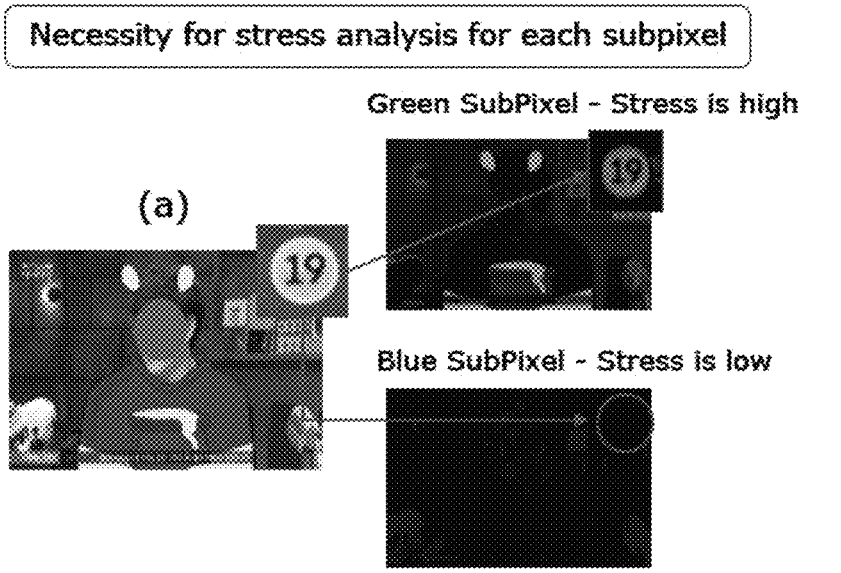

As illustrated in FIG. 15(*a*), in the expression of a logo in a circle, for example, accumulation of logo stress in green subpixels is insignificant, whereas high logo stress may be accumulated in blue subpixels. In this case, stress applied to green subpixels in FIG. 15(*b*) may be higher than stress applied blue subpixels in FIG. 15(*c*).

Figure 16:
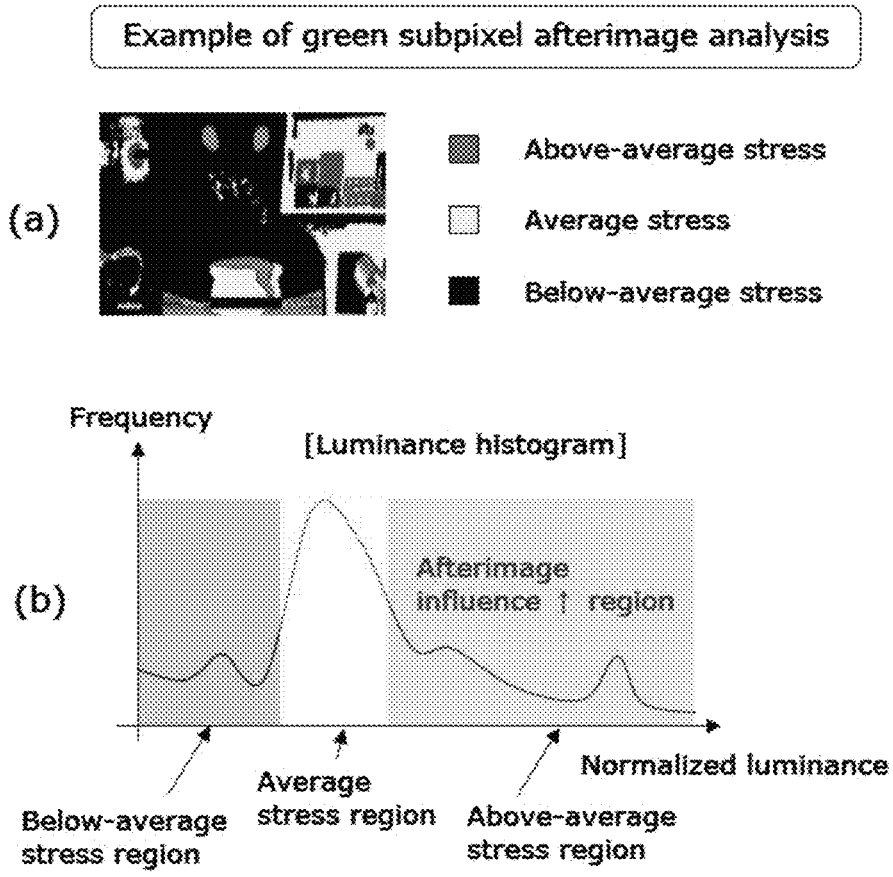

As illustrated in FIG. 16(*a*), different degrees of stress may be applied to the same green subpixels according to characteristics of an image to be displayed. Accordingly, when the image shown in FIG. 16(*a*) is represented as a luminance histogram, the image may be divided into a below-average stress region, an average stress region, and an above-average stress region, as shown in FIG. 16(*b*). In addition, as can be ascertained from the luminance histogram, the above-average stress region may be classified as a region having higher afterimage influence than other regions.

As described above, degrees of stress that can be accumulated in red, green and blue pixels may be different according to an image to be displayed, and different degrees of stress may be applied to subpixels according to characteristics of an image to be displayed even if the subpixels express the same color. Accordingly, it is desirable to calculate the afterimage influence for all pixels converted into luminances.

Next, a compensation gain for each subpixel may be derived on the basis of afterimage influence data (S170), a total gain corresponding to gains for positions of all pixels may be derived (S180), and the derived total gain may be applied (S190).

Figure 17:
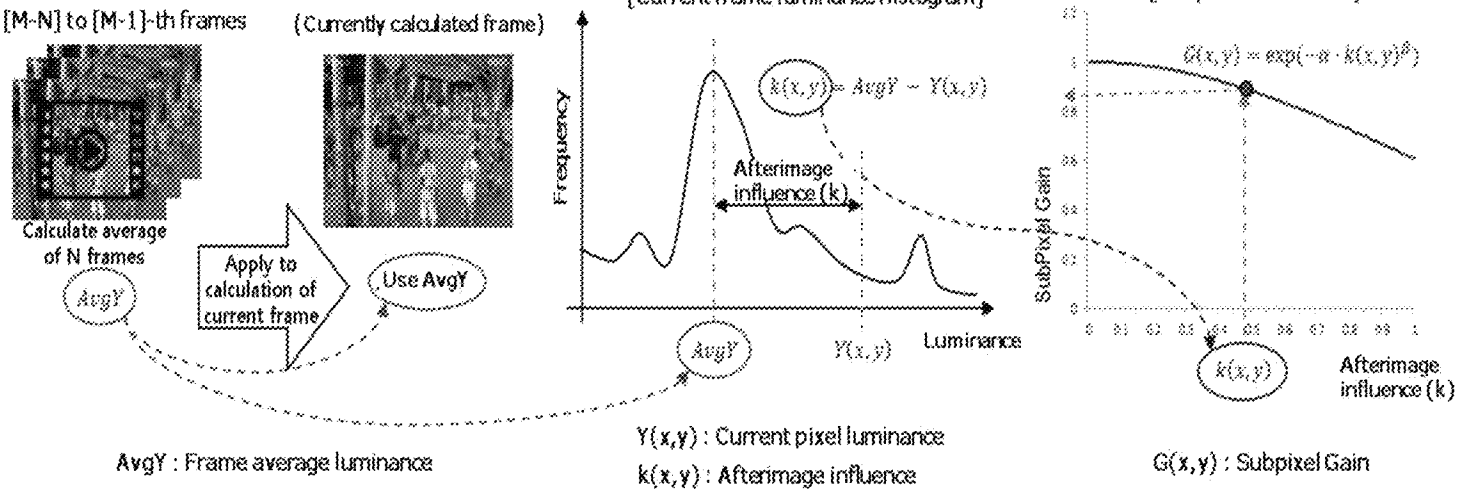

To derive a compensation gate for each subpixel on the basis of the afterimage influence data, as illustrated in FIG. 17, an average luminance AvgY to be applied to calculation of the current frame image may be calculated as illustrated in FIG. 17(*a*). The average luminance AvgY to be applied to the current frame image may be calculated on the basis of N (N being an integer equal to or greater than 2) frames.

When the average luminance AvgY of the current frame image is calculated, afterimage influence k for each subpixel position may be obtained on the basis of a luminance histogram of the current frame image, as illustrated in FIG. 17(*b*). The afterimage influence k for each subpixel position may be derived on the basis of the luminance histogram of the current frame image, defined as a difference between the average luminance of the current frame image and a luminance of the current pixel, such as "k(x, y)=AvgY−Y(x, y)". Here, it may be determined that the afterimage influence k is higher when the difference between the average luminance of the current frame image and the luminance of the current pixel is larger.

Meanwhile, to perform real-time compensation, an average luminance of previous N frame images may be used in calculation of the current frame image (memory use amount is reduced) when data similarity between neighboring frame images is high (data of the neighboring frame images are similar or identical). However, initial frame images may be output without compensation.

When data is stored and the memory is used in this manner, conditions in which real-time compensation can be performed on the basis of a low-capacity memory (EEPROM) instead of a frame memory may be arranged. For example, the average luminance AvgY of the current frame image may have a form of average luminance information of N frame images, such as "avgR, avgG, avgB, avgW" in FIG. 18 and may be stored separately for subpixels. In addition, the average luminance AvgY may be updated in a form of current frame image and previous N frame image information per frame.

As described above, since the afterimage influence due to stress in expression of an image may be different for subpixels, afterimage analysis for each subpixel is necessary. Afterimage may be recognized in a relatively less deteriorated part than the surrounding part. Accordingly, when an average luminance value of a frame image is retrieved and then afterimage influence is calculated on the basis of the average luminance value (or peripheral stress) of the frame image, a possibility of causing afterimage for each subpixel (or pixel) position can be easily evaluated (determined).

When data of the afterimage influence k derived through FIG. 17(*b*) is used, a compensation gain for each subpixel (SubPixel Gain(G)) may be derived, as illustrated in FIG. 17(*c*). The compensation gain for each subpixel (SubPixel Gain(G)) may be derived on the basis of a numerical value of a gain according to the afterimage influence k, "$G(x, y)=\exp(-\alpha \cdot k(x, y)^{\beta})$", along a determined curve such that stress (luminance) for each subpixel can be compensated. The compensation gain for each subpixel (SubPixel Gain (G)) may be derived on the basis of a stretched exponential form that is gentle near the average and becomes steep thereafter.

Even when the compensation gain for each subpixel (SubPixel Gain(G)) is derived, a color distortion problem may occur according to a method of applying the compensation gain for each subpixel. An example thereof is described as follows.

As illustrated in FIG. 19, after the compensation gain for each subpixel is derived, individual gain compensation may be applied in such a manner that a gain of 0.9 is applied to a red subframe (R-Subframe) image including a red subpixel and a gain of 0.7 is applied to a green subframe (G-Subframe) image including a green subpixel.

However, according to individual gain compensation, color shift may occur as represented by a result of compensation of frame data in the upper part of the figure. For example, a region in yellow looks reddish due to the influence of overcompensation of red.

As illustrated in FIG. 20, after the compensation gain for each subpixel is derived, common gain compensation may be applied in such a manner that 0.7 is applied to a red subframe (R-Subframe) image including a red subpixel and a green subframe (G-Subframe) image including a green subpixel.

However, according to the common compensation method, a problem that a specific subpixel is overcompensated may occur as represented by a result of compensation of frame data in the upper part of the figure. For example, the green subpixel is overcompensated as compared to the red subpixel.

To prevent generation of the aforementioned problems, a total gain for each pixel position may be derived. The total gain may be derived by weighting the compensation gain for each subpixel (SubPixel Gain(G)) on the basis of normalized luminance Y.

The reason why the compensation gain for each subpixel (SubPixel Gain(G)) is weighted on the basis of normalized luminance Y in this manner is that, because a subpixel having a higher normalized luminance has higher stress, it is desirable to increase a weight for the subpixel and reflect the weight in the total gain. The total gain may be derived on the basis of Equation 5.

$$TotalGain(x, y) = \frac{G_r(x, y) \cdot Y_r(x, y) + G_g(x, y) \cdot Y_g(x, y) + G_b(x, y) \cdot Y_b(x, y) + G_w(x, y) \cdot Y_w(x, y)}{Y_r(x, y) + Y_g(x, y) + Y_b(x, y) + Y_w(x, y)} \quad \text{[Equation 5]}$$

In Equation 5, G(x, y) means a gain for each subpixel and Y(x, y) means a normalized luminance.

The total gain derived according to Equation 5 may be commonly applied to all pixels (or all subpixels). When the total gain (Total Gain (x,y)) is commonly applied to all pixels (or all subpixels) in this manner, the color distortion problem occurring in the method of respectively applying gains for subpixels can be solved.

When the original image is compensated using the above-described afterimage delaying method, higher stress regions (refer to regions indicated by dotted lines, which are examples of stress compensation positions) as compared to other regions can be compensated, as shown in a compensated image of FIG. 21.

Next, pixel data compensated through the aforementioned process may be output (S200), it is checked whether the current pixel is the last pixel (S210), and output of the compensated image #M Frame' provided through the previous process may be completed (S230) if the current pixel is the last pixel (Y). However, if the current pixel is not the last pixel (N), the flow may return to step S150 in order to complete compensation for all pixels.

FIG. 22 and FIG. 23 are diagrams for explaining a comparative example and an embodiment of the present invention in comparison.

A light emitting display device of the comparative example can standardize luminance of a less deteriorated part downward and perform compensation in a time cycle. On the other hand, a light emitting display device of the embodiment can reduce the luminance of a highly deteriorated part in advance and perform real-time compensation for each frame. The comparative example and the embodiment are compared with each other as follows.

Comparative Example

When a frame image causing deterioration is input, the light emitting display device of the comparative example displays the frame image as it is without compensation, as shown in FIG. 22(*a*). When the light emitting display device of the comparative example is deteriorated for 500 hours and then the deterioration is checked in a state in which a full white pattern is displayed, the luminance of the center region is reduced, as shown in FIG. 22(*b*).

When the light emitting display device of the comparative example is additionally deteriorated for 500 hours and then the deterioration is checked in a state in which a full white pattern is displayed, a gain for compensating for the peripheral region is applied, as shown in FIG. 22(*d*).

Embodiment

When a frame image causing deterioration is input, the light emitting display device of the embodiment reduces the luminance of a region having afterimage influence and displays the frame image, as shown in FIG. 22(*a*'). When the light emitting display device of the embodiment is deteriorated for 500 hours and then the deterioration is checked in a state in which a full white pattern is displayed, the luminance of the center region is reduced, as shown in FIG. 22(*b*'), but a degree of deterioration is lower than that of the comparative example due to the luminance reduced in advance.

When the light emitting display device of the embodiment is additionally deteriorated for 500 hours and then the deterioration is checked in a state in which a full white pattern is displayed, a gain for compensating for the center region is applied, as shown in FIG. 22(*d*').

As can be ascertained through description of the comparative example and the embodiment, the embodiment can reduce a possibility of generation of afterimage due to deterioration by decreasing the luminance of a region having afterimage influence (highly deteriorated part) in an input image. In addition, as can be ascertained from afterimage improvement rates illustrated in FIG. 23, the embodiment can achieve a higher afterimage improvement rate in red, green, blue, and white, and an average thereof than the comparative example.

The present invention has the effect of reducing a possibility of generation of afterimage due to deterioration by decreasing the luminance of a region having afterimage influence (highly deteriorated part) in an input image. Furthermore, the present invention has the effect of improving display quality of images and increasing the lifespan of a display device by reducing the possibility of generation of afterimage due to deterioration.

It will be apparent to those skilled in the art that various modifications and variations can be made in the display device and the driving method thereof of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a timing controller for calculating an average luminance for each subpixel with respect to an input image, calculating afterimage influence for each subpixel for determining a possibility of causing afterimage for each subpixel position on the basis of the average luminance, and deriving a compensation gain for each subpixel on the basis of the afterimage influence for each subpixel to provide the input image as a compensated image;

a data driver for outputting a data voltage on the basis of the compensated image output from the timing controller; and a display panel for displaying an image on the basis of the data voltage, wherein the timing controller is configured to provide the input image as the compensated image by weighting the compensation gain for each subpixel on the basis of a normalized luminance to derive a total gain corresponding to gains for positions of all pixels included in the input image, and commonly applying the total gain to all the pixels.

2. The display device of claim 1, wherein the timing controller is configured to provides the compensated image by decreasing a luminance of a region having the afterimage influence in the input image in advance such that the possibility of causing afterimage is reduced.

3. The display device of claim 1, wherein the timing controller is configured to determine that the larger a difference between an average luminance of a current image and a luminance of a current pixel, the higher the afterimage influence.

4. The display device of claim 1, wherein the timing controller is configured to separate channels for subpixels along with calculation of the average luminance for each subpixel with respect to the input image.

5. The display device of claim 1, wherein the timing controller is configured to calculate the average luminance for each subpixel with respect to the input image per frame, store the average luminance in a memory, update the average luminance, and perform an operation of retrieving the average luminance for each subpixel from the memory whenever calculating the afterimage influence for each subpixel.

6. A method of driving a display device, comprising:

calculating an average luminance for each subpixel with respect to an input image;

calculating afterimage influence for each subpixel for determining a possibility of causing afterimage for each subpixel position on the basis of the average luminance;

providing the input image as a compensated image by deriving and applying a compensation gain for each subpixel on the basis of the afterimage influence for each subpixel; and displaying an image on the basis of the compensated image, wherein the providing of the input image as a compensated image comprises weighting the compensation gain for each subpixel on the basis of a normalized luminance to derive a total gain corresponding to gains for positions of all pixels included in the input image, and commonly applying the total gain to all the pixels.

7. The method of claim 6, wherein the compensated image is provided by decreasing a luminance of a region having the afterimage influence in the input image in advance such that the possibility of causing afterimage is reduced.

* * * * *